US006814423B2

(12) United States Patent
Jefferson et al.

(10) Patent No.: US 6,814,423 B2
(45) Date of Patent: Nov. 9, 2004

(54) CAPPING SYSTEM FOR A PRINTHEAD

(75) Inventors: Jafar N. Jefferson, Vancouver, WA (US); William T. Stephenson, Vancouver, WA (US); Jeffrey K. Pew, Lake Oswego, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 152 days.

(21) Appl. No.: 10/173,908

(22) Filed: Jun. 18, 2002

(65) Prior Publication Data

US 2003/0231222 A1 Dec. 18, 2003

(51) Int. Cl.[7] ..... B41J 2/165
(52) U.S. Cl. ..... 347/29
(58) Field of Search ..... 347/29, 85, 84, 347/86, 87, 32, 14, 90, 30, 23, 31, 22, 20, 1, 5, 7, 9

(56) References Cited

U.S. PATENT DOCUMENTS 5,867,184 A 2/1999 Quintana
6,168,257 B1 1/2001 Aldrich
6,203,136 B1 * 3/2001 Takahashi et al. ..... 347/29

* cited by examiner

*Primary Examiner*—Raquel Yvette Gordon

(57) ABSTRACT

A capping system for a printhead comprises a frame including first and second surfaces, said second surface inclined with respect to said first surface, and a sealing member adapted for movement on said frame between a nominal position and a sealing position in contact with the printhead, said sealing member including a first support member adapted for rotational movement with respect to said first surface of the frame, and a second support member adapted for translational movement with respect to said second surface.

29 Claims, 5 Drawing Sheets

Fig. 2
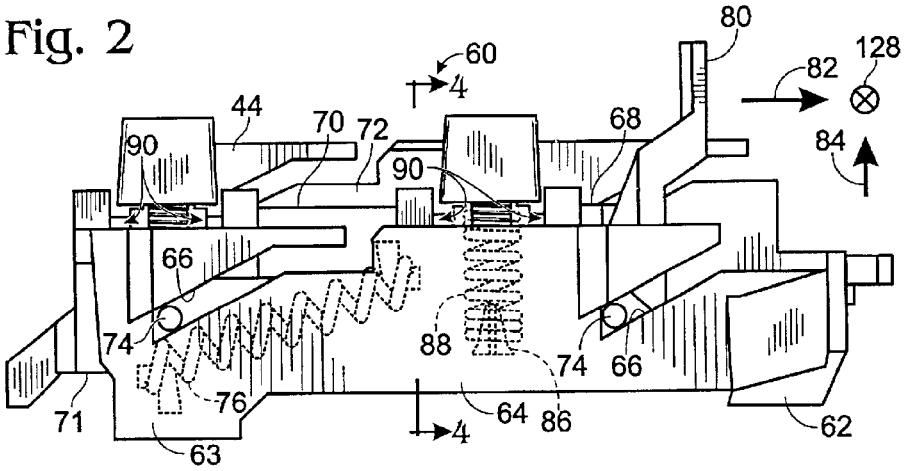
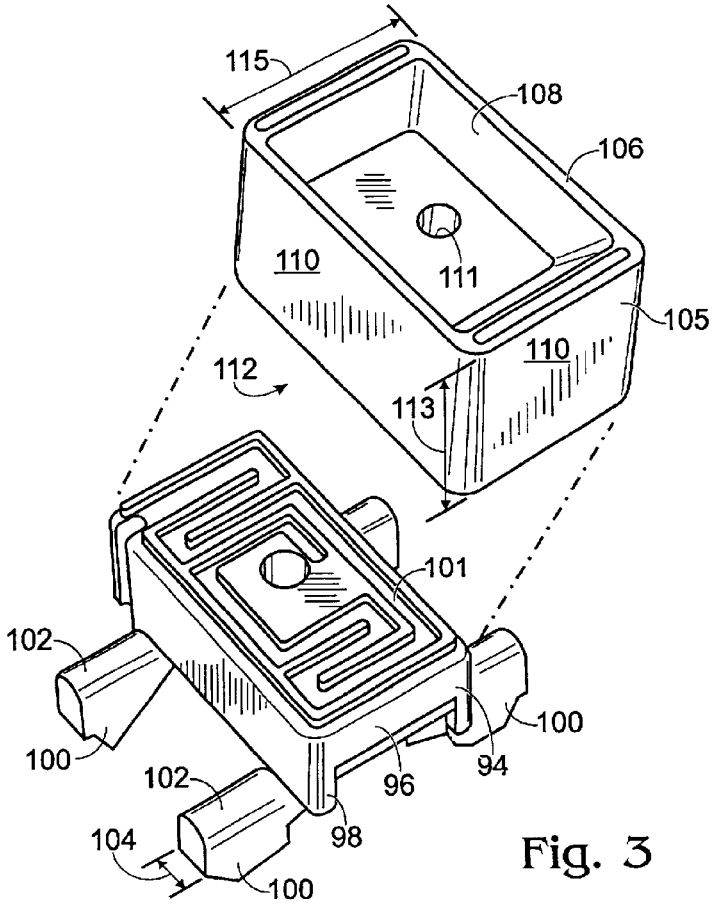
Fig. 3

CAPPING SYSTEM FOR A PRINTHEAD

BACKGROUND

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, a "service station" mechanism can be mounted within the printer chassis so the printhead can be moved over the station for maintenance. For storage, or during non-printing periods, the service stations usually include a capping system which seals the printhead nozzles from contaminants and drying. To form a good seal, the cap can conform to the printhead and supply enough force against the printhead to limit air transfer.

Printer systems can employ a motor to actuate movement of the printhead carriage system. Additionally, printer systems can utilize a second, dedicated motor or transmission to actuate movement of the capping system into contact with the printhead to order to cap the printhead nozzles. Incorporation of this second, dedicated motor into the printer design adds significant cost to the overall cost of the printer. Printer systems that make use of a single motor could therefore realize a cost savings over those that make use of two motors.

SUMMARY OF THE INVENTION

A capping system for a printhead comprises a frame including first and second surfaces, said second surface inclined with respect to said first surface, and a sealing member adapted for movement on said frame between a nominal position and a sealing position in contact with the printhead, said sealing member including a first support member adapted for rotational movement with respect to said first surface of the frame, and a second support member adapted for translational movement with respect to said second surface.

BRIEF DESCRIPTION OF THE DRAWINGS

FIG. 2 is a side view of one form of a service station of FIG. 1, including the capping system.

FIG. 3 is a perspective view of one form of a cap and a cap base of FIG. 1.

DETAILED DESCRIPTION OF THE DRAWINGS

Figure 1A:
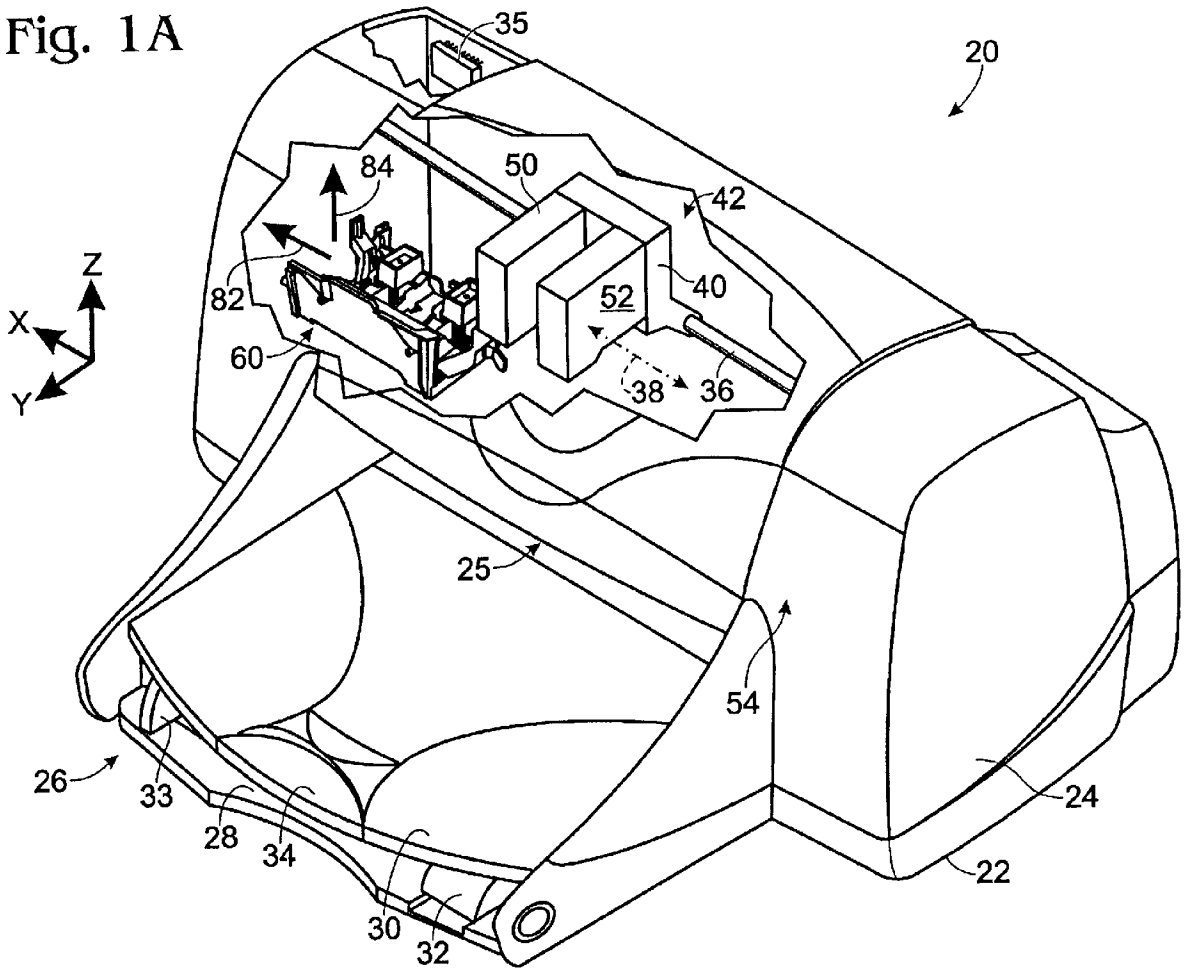
FIG. 1A is a perspective view of one form of an inkjet printing mechanism, here shown as an inkjet printer, having one form of the capping system.

FIG. 1A illustrates one embodiment of an inkjet printing mechanism, here shown as an inkjet printer 20, which may be used for printing of business reports, correspondence, desktop publishing, and the like, in an industrial, office, home or other environment. A variety of inkjet printing mechanisms are commercially available. For instance, some of the printing mechanisms that may use embodiments of the capping system include plotters, portable printing units, copiers, cameras, video printers, and facsimile machines, to name a few. For convenience the concepts of the capping system are illustrated in the environment of an inkjet printer 20.

While it is apparent that the printer components may vary from model to model, the inkjet printer 20 includes a chassis 22 surrounded by a housing or casing enclosure 24, typically of a plastic material. Sheets of print media are fed through a printzone 25 by an adaptive print media handling system 26. The print media may be any type of suitable sheet material, such as paper, card-stock, transparencies, mylar, and the like, but for convenience, the illustrated embodiment is described using paper as the print medium. The print media handling system 26 typically has a feed tray 28 for storing sheets of paper before printing. A series of motor-driven paper drive rollers (not shown) may be used to move the print media from tray 28 into the printzone 25 for printing. After printing, the sheet then lands on output tray portion 30. The media handling system 26 may include a series of adjustment mechanisms for accommodating different sizes of print media, including letter, legal, A-4, envelopes, etc., such as a sliding length and width adjustment levers 32 and 33 for the input tray, and a sliding length adjustment lever 34 for the output tray.

The printer 20 also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. The printer controller 35 may also operate in response to user inputs provided through a key pad (not shown) located on the exterior of the casing 24. A monitor coupled to the computer host may be used to display visual information to an operator, such as the printer status or a particular program being run on the host computer.

Figure 1B:
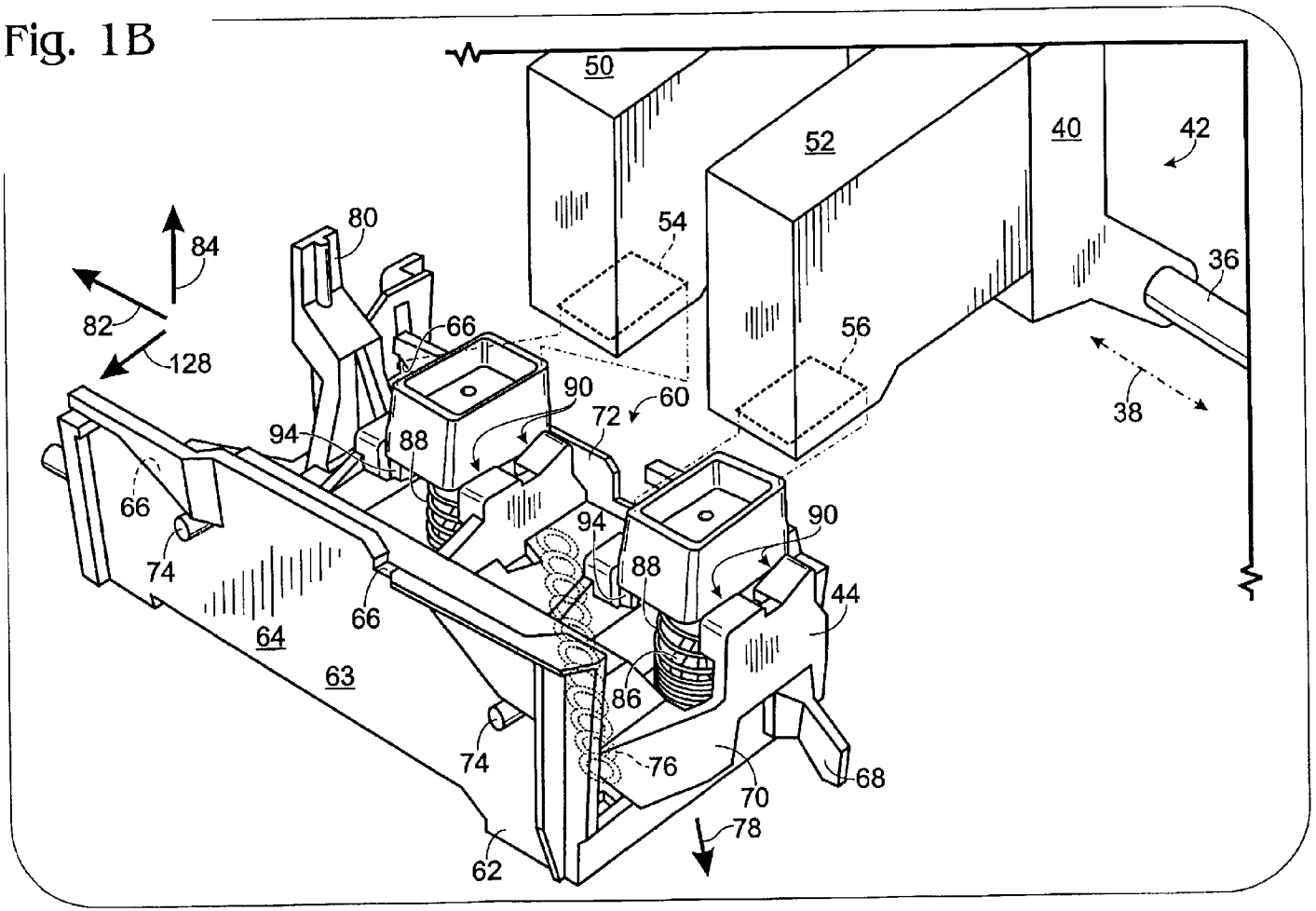
FIG. 1B is a detailed view of the capping system of FIG. 1A.

FIG. 1B illustrates a carriage guide rod 36 mounted to the chassis 22 (FIG. 1A) to define a scanning axis 38. The guide rod 36 slideably supports a reciprocating inkjet carriage 40, which travels back and forth across the printzone 25 and into a servicing region 42. Housed within the servicing region 42 is a service station 44, which will be discussed in greater detail below with respect to embodiments of the present invention. The illustrated carriage 40 carries two inkjet cartridges or pens 50 and 52 over the printzone 25 for printing, and into the servicing region 42 for printhead servicing. Each of the pens 50 and 52 have an inkjet printhead 54 and 56, respectively, which selectively eject droplets of ink in response to firing signals received from the controller 35.

One suitable type of carriage support system is shown in U.S. Pat. No. 5,366,305, assigned to Hewlett-Packard Company, the assignee of the subject application. Any carriage propulsion system may be used to drive the carriage 40, including a position feedback system, which communicates carriage position signals to the controller 35. For instance, a carriage drive gear and DC motor assembly may be coupled to drive an endless belt secured to the pen carriage 40, with the motor operating in response to control signals received from the printer controller 35. To provide carriage positional feedback information to printer controller 35, an optical encoder reader may be mounted to carriage 40 to read an encoder strip extending along the path of carriage travel.

In order to reduce the cost of producing printing mechanisms, the printhead motor can be used to actuate movement of a capping system. Use of the printhead motor to actuate movement of the capping system poses several problems. First, by using the scan-axis direction motion of the printhead carriage to actuate the cap sled, the sled is not coupled to the carriage in the paper-axis direction. This makes it more difficult to maintain alignment between the caps and the printheads in the paper-axis direction. Second, because the printhead carriage typically has some play around the carriage rod, the carriage typically is allowed to rotate and lift off of the carriage rod during capping. It would be beneficial, therefore, for Cap designs to be able to accommodate a considerable degree of motion in order to remain coupled to the printheads during rotation of the printhead carriage about the carriage rod even though the cap system may not include its own dedicated motor.

Still referring to FIG. 1B, in the printzone 25, the media sheet receives ink from the inkjet cartridges 50 and 52, such as a black ink cartridge 50, and/or a color ink cartridge 52. Any number of cartridges can be used. The cartridges 50 and 52 are also often called "pens" by those in the art. It is apparent that any type of inks and/or colors may be used in pens 50 and 52, such as dye-based inks, pigment based inks, thermoplastic, wax or paraffin based inks, as well as hybrid or composite inks having both dye and pigment characteristics. The illustrated pens 50 and 52 each include reservoirs for storing a supply of ink.

The printheads 54 and 56 each have an orifice plate with a plurality of nozzles formed therethrough. The illustrated printheads 54 and 56 are thermal inkjet printheads, although other types of printheads may be used, such as piezoelectric printheads. Printheads 54 and 56 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a multi-conductor strip (not shown) from the controller 35 to the printhead carriage 40, and through interconnects between the carriage and pens 50 and 52 to the printheads 54 and 56.

FIGS. 1A, 1B and 2 show the service station 44 as including an embodiment of a capping system, capping system 60, constructed in accordance with one embodiment of the present invention. The service station 44 includes a cap support frame 62 having a lower base portion 63 and upwardly extending side walls 64. Side walls 64 include ramped apertures or grooves 66 therein for receiving outwardly extending projections 74 of the cap sled 68. Cap sled 68 includes a central base portion 70 and side walls 72. Central base portion 70 defines a plane 71, also called a base plane and a support plane, that in this embodiment is parallel to the x-y plane (shown in side view in FIG. 2). Side walls 72 typically include four outwardly extending projections 74 received within ramped grooves 66 of the cap frame (only two projections 74 can be seen in these views). The cap sled is shown in its nominal rest position wherein an embodiment of a biasing element such as spring 76 (shown in dash lines) biases the cap sled downwardly toward cap frame 62, such that projections 74 are biased into a lowermost portion of grooves 66, and such that the sled is biased in a diagonal direction 78 within the cap frame, i.e., biased toward the lower, right-front corner of the capping system of FIG. 1B.

Cap sled 68 further includes an upwardly extending arm 80 that is contacted by the printhead, or by another arm contacting surface of printhead carriage 40, and moved in a direction 82, when the printhead is moved into the printhead servicing region. Upon contact of the printhead with arm 80 in direction 82, the entire cap sled is moved relative to frame 62 in direction 82, against the force of spring 76, and upwardly in direction 84, due to the position of projections 74 within ramped apertures 66 of the cap frame. Such movement of the cap sled moves the caps into position for initial contact with corresponding ones of the printheads 54 and 56. Through contact of the printhead carriage with arm 80, the printhead motor is used to actuate movement of the capping system.

Cap sled 68 includes an upwardly extending tab 86 (shown in FIG. 2 in dash lines) to secure an embodiment of a cap biasing element, such as spring 88, thereon, spring 88 biases the cap in upward, Z-direction 84 away from the cap sled. Cap sled 68 further includes multiple sets of apertures 90 spaced and oriented in such a manner that the caps are biased into well-controlled, nominal rest positions for initial contact with their corresponding printheads, as will be described in more detail below.

FIG. 3 shows one embodiment of the cap base and cap. Cap base 94 comprises a central base region 96 and a lower region 98 having four projections, or legs, 100 extending outwardly therefrom. A top surface of central base region 96 may comprise a recessed pathway 101, so as to moderate the pressure and control the humidity of the sealed printhead nozzles when the nozzles are sealed by the cap. Each of legs 100 is spaced and sized so as to be received within set of apertures 90 on cap sled 68. Each of legs 100 typically has a smooth, rounded upper surface 102 so as to allow pivoting movement of the projections within apertures 90. The cap base typically is manufactured of a resilient and somewhat inflexible material such as acetal.

Cap 105, also called a seal or a sealing member, comprises a printhead contacting upper surface, or lip, 106 that defines an upper recessed region 108. In this embodiment, the lip 106 forms a rectangular capping structure which seals against the orifice plates of printheads 54 and 56, with the rectangular structure being sized to surround the nozzles extending through the orifice plate. While a rectangular shaped cap is useful for linear nozzle arrays, it is apparent that other capping geometries may also prove useful in other implementations. When properly positioned against a printhead, lip 106 contacts the printhead and surrounds the printhead nozzles such that the nozzles are sealed within recessed region 108. Cap 105 further includes sidewalls 110 that extend downwardly from lip 106 and define a lower, hollow interior region 112 sized to frictionally engage central base region 96 of cap base 94. The cap 105 may include an aperture 111 that extends from hollow interior region 112 to recessed region 108 so that recessed pathway 101 of the cap base may be used to control the sealed environment of the printhead nozzles when the cap is sealed thereto. The caps may be constructed of a resilient, non-abrasive, elastomeric material, such as nitrile rubber, ethylene polypropylene diene monomer (EPDM), or other comparable materials.

Still referring to FIG. 3, top surfaces 102 of projections 100 are positioned a vertical distance 113 from lip 106 (when the cap 105 is secured on cap base 94), which is less than a width 115 of cap 105. This relatively small vertical distance 113, together with the use of a plurality of projections 100 reduces "wobble" problems. Moreover, in another embodiment, top surfaces 102 of the projections 100 can be manufactured to be in the same plane as lip 106 because the projections are not positioned below the cap but instead extend outwardly from the sides of the cap.

Figure 4:
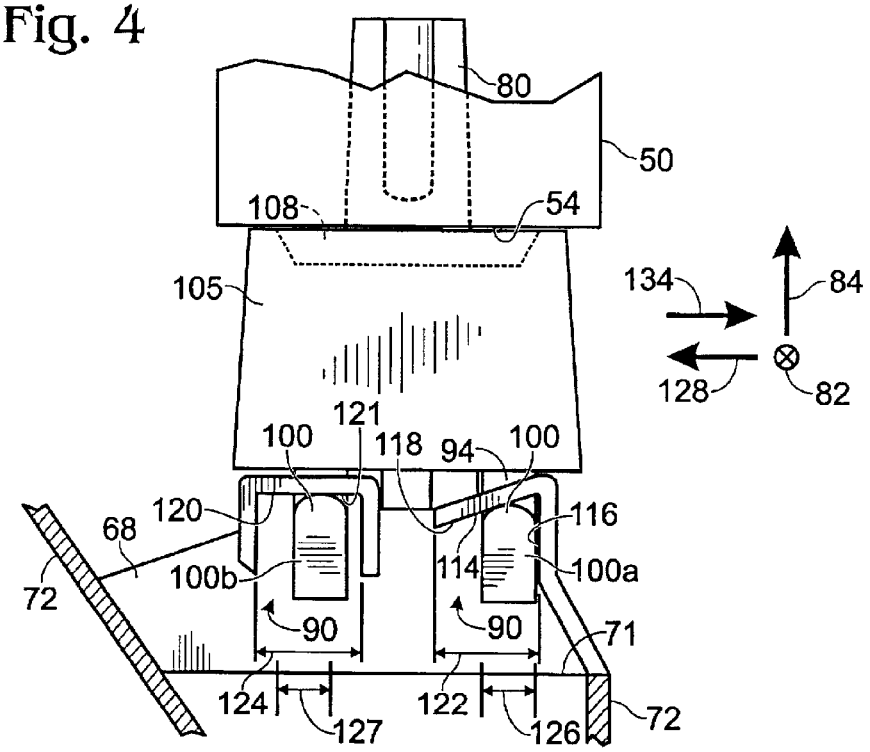
FIG. 4 is a side cross-sectional view, taken along line 4—4 of FIG. 2, of the cap base coupled to the cap sled in an initial position, just prior to contact with the printhead.

FIG. 4 is a side cross-sectional view of the cap base coupled to the cap sled of FIG. 1A in an initial position, prior to contact with the printhead. (In FIGS. 4–6 spring 88 is not shown for ease of illustration). Cap base 94 is biased upwardly in direction 84 by spring 88 such that each of legs 100 of the cap base is biased upwardly within apertures, also called recesses, 90 of the cap sled 68. Each set of apertures 90 typically comprises four downwardly extending apertures wherein a first set of apertures 114 (only one of apertures 114 is visible in this view) comprise a vertical stop surface 116 and a sloped or inclined surface 118 that slopes downwardly from stop surface 116. Inclined surfaces 118 preferably have a downward slope of approximately twenty-five degrees, and typically have a slope in a range of fifteen to forty-five degrees, with respect to the un-sloped upper surface 121 of apertures 120 and with respect to plane 71, i.e., the x-y plane in this embodiment, of the cap sled. However, any angle from one to eighty nine degrees would likely allow for functioning of capping system 60. Second set of apertures 120 (only one of apertures 120 is visible in this view) typically comprise an inverted "U" shape, having a generally flat upper surface 121. In this embodiment, surfaces 121 are shown as completely flat and parallel to plane 71 so as to facilitate pivotal/rotational movement thereon of the rounded surfaces 102 of projections 100. However, any "generally flat" shaped surface that facilitates pivotal movement of projections 100 thereon, such as a rounded, concave or arched surface, would function in a similar manner.

Each of apertures 114 and 120 has a width 122 and 124, respectively, that is greater than a width 126 and 127, respectively, of projections 100*a* and 100*b*, such that the apertures are sized to allow movement of a cap base projection 100 therein. Due to the spring 88 and the sloped or inclined orientation of surface 118 of first set of apertures 114, in the nominal position, the cap base is biased in a forward direction 134, opposite to y-direction 128 such that each of projections 100*a* contact their corresponding stop surfaces 116. Due to spring element 76 (FIG. 2), the cap sled and the attached cap 105 are biased within the cap frame in a direction opposite x-direction 82 (shown extending into the page in this figure), in y-direction 128, also called the paper-axis and the printmedia feed direction, and downwardly into the cap frame in a direction opposite upward z-direction 84. Accordingly, the initial, resting, nominal position of the cap, even in the printmedia feed direction 128, is well defined and controlled such that the cap is properly positioned for contact with the printhead during servicing thereof.

Figure 5:
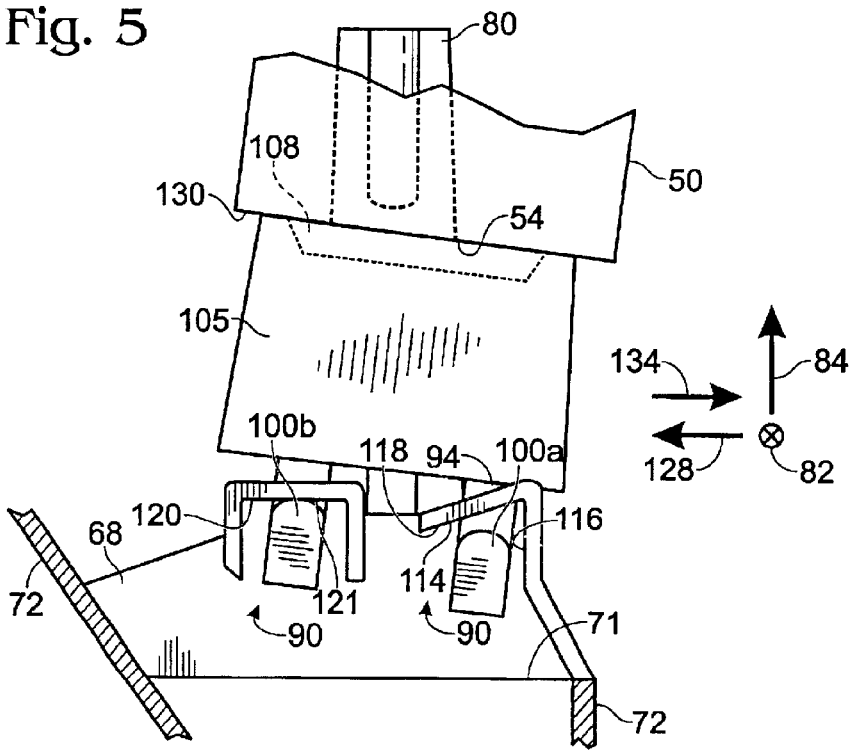
FIG. 5 is a side cross-sectional view of the cap base of FIG. 4 partially de-coupled from the cap sled wherein the cap has been contacted by the printhead and the cap base is translated in the printmedia feed direction and is slightly rotated.

FIG. 5 is a side cross-sectional view of the cap base of FIG. 4 partially de-coupled from the cap sled wherein cap 105 has just been contacted by the printhead along a leading edge and the cap is translated in the printmedia feed direction 128, and slightly rotated, i.e., pivoted about projections 100*b* retained within apertures 120. In particular, when printhead 54 is moved into a servicing position, the printhead typically is slightly rotated about the carriage rod such that a cap contacting surface 130 of the printhead typically is slightly angled with respect to plane 71. Initial contact between the printhead 54 and cap 105, therefore, typically is between a forward edge 132 of lip 106 of the cap and printhead surface 130. As the printhead forces the cap sled in the x-direction 82, the sled is moved upwardly by the position of projections 74 within ramped apertures 66. As the cap sled is forced upwardly toward the printhead, the printhead surface 130 forces the cap to move slightly translationally in direction 128, such that all four legs 100*a* and 100*b* move slightly translationally, i.e., laterally, within apertures 90. The printhead head surface 130 also forces front edge 132 of the cap downwardly such that the cap rotates or pivots about rear legs 100*b* within apertures 120 (only one of the legs 100*b* and apertures 120 are visible in this figure). Due to the small width of legs 100 compared to the width of apertures 90, such translational and pivotal/rotational motion is permitted within apertures 90. In the position shown, wherein legs 100*a* are moved downwardly and away from inclined surface 118, and wherein the cap base has been translated slightly rearwardly in direction 128, the cap is in a partially de-coupled orientation, meaning that only rearward legs 100*b* of the cap base are positioned upwardly against the upper surface of apertures 90.

Figure 6:
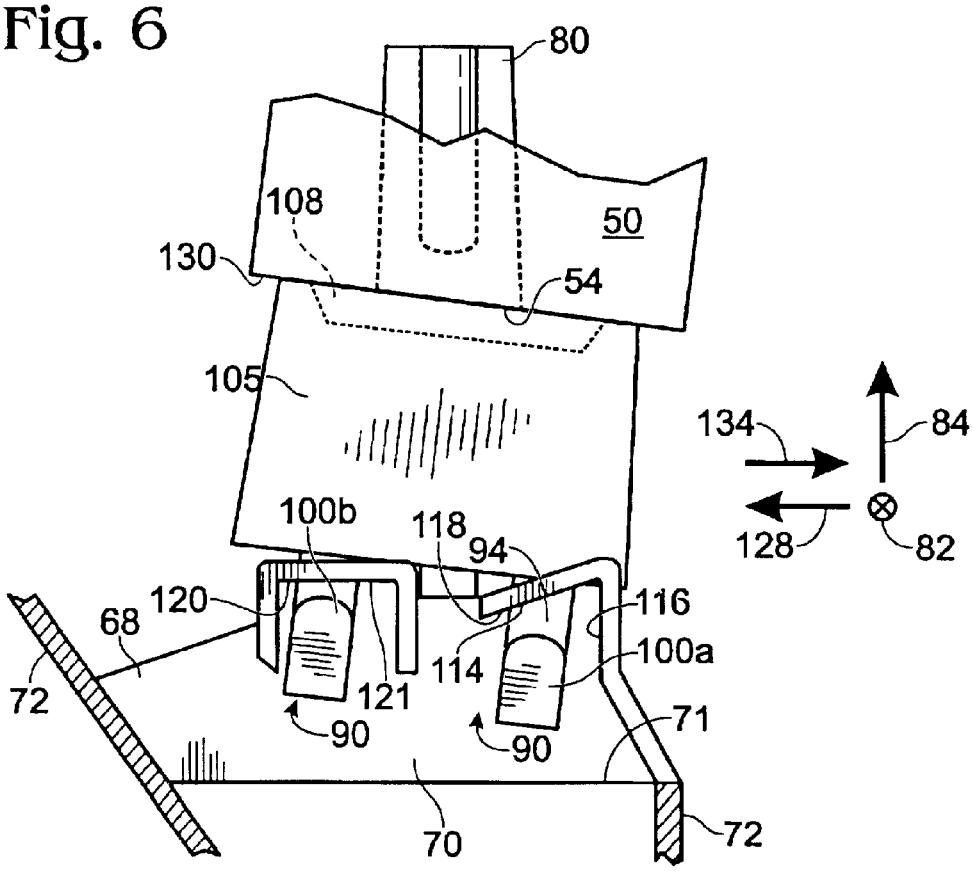
FIG. 6 is a side cross-sectional view of the cap base of FIG. 4 de-coupled from the cap sled wherein the cap has been contacted by the printhead and the cap base is translated in the printmedia feed direction, is slightly rotated, and the cap base legs are no longer in contact with the cap sled.

FIG. 6 is a side cross-sectional view of the cap base of FIG. 1 completely decoupled from the cap sled wherein the cap has been contacted around the entire cap edge 106 by the printhead surface 130 and the cap base is translated in the feed direction 128, slightly rotated with respect to x-axis 82, and the cap base legs 100*a* and 100*b* are de-coupled from the cap sled, i.e., not in contact with recesses 90. The cap is said to be de-coupled from the cap sled even though legs 100 are still retained within apertures 90. In this view, the cap sled has been pulled upwardly along ramps 66 of the cap frame such that the entirety of lip 106 of the cap is in contact with the printhead 50. The printhead has forced the cap rearwardly and downwardly such that cap base 94 compresses spring 88 (FIG. 2), legs 100*a* are moved rearwardly away from stop surface 116, and legs 100*a* and 100*b* are both moved downwardly from contact with the upper surfaces, respectively, 118 and 121, of apertures 90. Due to the small size of the width of legs 100 relative to the width of apertures 90, the cap in this position has relative freedom of movement to follow movement of the printhead. Accordingly, lip 106 of cap 105 is maintained in contact with printhead surface 130 by friction, and such frictional sealing engagement is not destroyed by constraints on movement of the cap base 94 relative to the cap sled 68. Once the printhead 50 is removed from contact with cap 105, spring 88 will once again bias the cap into the initial, rest position wherein the cap base legs 100 are biased upwardly in direction 84, and forwardly in direction 134, within apertures 90.

The degree of movement experienced by an individual cap 105 depends upon the movement and orientation of its corresponding printhead. Thus, individual caps may accommodate planar variances between different printheads in a single printer. Furthermore, different degrees of movement by individual caps 105 may be experienced between the various caps in a single service station, thereby allowing each cap to compress to a different degree to accommodate different seating depths of pens 50 and 52 within carriage 40, as well as variations in the elevation of the orifice plates of printheads 54 and 56 due to various manufacturing tolerances within the pens themselves or within the carriage.

The sloped surface of apertures 118 allows well-controlled initial alignment of the caps to the printheads even in the direction 128 perpendicular to the carriage axis 38 and perpendicular to the x-axis, or scan direction, 82. When the cap base legs 100 are moved out of contact with the upper surfaces of cap sled apertures 114 and 120, the cap is allowed relative freedom of movement to follow the printhead. Accordingly, this design allows the caps to be moved a considerable distance while maintaining a seal on the nozzles, thereby reducing drying or contamination of the pens. Another benefit to having such a large range of movement of the caps is the cost savings resulting from reduced part tolerance requirements, allowing both the printer 20 and the pens 50 and 52 to be more economically constructed.

There is described a printer having a servicing station wherein the initial position of the cap relative to the printhead carriage is controlled in the x, y and z directions. Aligning the cap in the printmedia feed direction with the printhead positioned by the printhead carriage allows the cap to properly engage the printhead pen surface. Once the cap engages the printhead pen surface, and the pen surface is coupled to the cap by friction, the cap base is able to translate in the paper-axis direction and to rotate or pivot to track the motion of the carriage as the upward capping forces cause the carriage to rotate backwardly around the carriage rod. The capping system 60 allows for this cap base motion to occur even before there is full de-coupling of the cap base from the cap sled. The capping system 60 also allows for the cap base legs to engage the cap sled in a very wide stance, with a relatively small vertical distance from the sled connection to the top of the cap, thereby reducing misorientation due to variation in manufacturing of parts, and reducing vertical "wobble" problems.

While the illustrated embodiment shows the cap sled 68 carrying two caps 105, it is apparent that the cap sled may be designed to carry one or any number of caps and/or other printhead servicing components, such as wipers, solvent applicators, or primers, to name a few. In yet another embodiment, a plurality of caps may be mounted on a single cap base having a single set of legs retained within a single set of apertures on a cap sled.

And finally, the illustrated embodiment of FIGS. 1–6 is shown to illustrate the principles and concepts of the invention as set forth in the claims below, and a variety of modifications and variations may be employed in various implementations while still falling within the scope of the claims below.

We claim:

1. A capping system for a printhead, comprising:

a frame including first and second surfaces, said second surface inclined with respect to said first surface; and a sealing member adapted for movement on said frame between a nominal position and a sealing position in contact with the printhead, said sealing member including a first support member adapted for rotational movement with respect to said first surface of the frame, and a second support member adapted for translational movement with respect to said second surface.

2. A capping system according to claim 1 further comprising a biasing member positioned between said sealing member and said frame and adapted to bias said first support member so that said rotational movement includes pivotal movement of said first support member against said first surface and said translational movement includes sliding movement of said second support member along said second surface.

3. A capping system according to claim 1 wherein the printhead includes nozzles adapted to eject ink therefrom.

4. A capping system according to claim 1 further comprising a support having a ramped recess, said frame secured to said support at said ramped recess and adapted for movement along said ramped recess from a rest position to a capping position.

5. The capping system according to claim 4 wherein said movement of said frame along said ramped recess includes horizontal motion and vertical motion with respect to said support.

6. A capping system for sealing around ink-ejecting nozzles of a printhead in an inkjet printing mechanism that defines a printmedia feed plane, comprising:

a support that includes a first recess including a first contacting surface positioned substantially parallel to the printmedia feed plane and a second recess including a second contacting surface inclined with respect to the printmedia feed plane; and a cap movably mounted on said support between a rest position and a sealing position wherein the cap surrounds the nozzles of the printhead, the cap including a first projection captured by said first recess and a second projection captured by said second recess, wherein in an absence of contact of the cap with the printhead said first projection contacts said first contacting surface, said second projection contacts said second contacting surface, and said second contacting surface biases said cap in said printmedia feed plane and into the rest position.

7. The capping system accordingly to claim 6 wherein said second recessed region further includes a third contacting surface positioned perpendicular to said printmedia feed plane and defining a stop position of the second projection when said cap is in the rest position.

8. The capping system according to claim 6 further including a biasing element secured to said support, in an absence of contact of the cap with the printhead said biasing element biasing said second projection against said second contacting surface.

9. The capping system according to claim 6 wherein said first projection defines a width less than a width of said first recessed region, and said second projection defines a width less than a width of said second recessed region.

10. The capping system according to claim 6 wherein said first and second projections each define a rounded surface for contacting, respectively, said first contacting surface and said second contacting surface.

11. The capping system according to claim 6 wherein when the cap is in the sealing position said first projection does not contact the first contacting surface and said second projection does not contact the second contacting surface.

12. The capping system according to claim 6 wherein said support comprises a cap frame, a sled biasing element, and a cap sled movably mounted thereon, wherein said cap is movably mounted on said cap sled, and wherein said sled biasing element is secured between said frame and said sled so as to bias said sled diagonally with respect to said frame.

13. The capping system according to claim 6 wherein said second surface defines an angle with respect to said printmedia feed plane in a range of fifteen to forty-five degrees.

14. A method of sealing ink ejecting nozzles of a printhead, comprising:

providing a cap support that defines a support plane, the cap support including a first surface parallel to said support plane and a second surface inclined with respect to said support plane;

providing a cap coupled to said cap support at said first surface and at said second surface, wherein said second surface biases said cap into an initial position;

contacting said cap with a printhead such that said cap is de-coupled from said first surface and said second surface, and such that said cap seals around the ink-ejecting nozzles of the printhead.

15. A method according to claim 14 further comprising removing said printhead from contact with said cap whereupon the cap is re-coupled to said cap support at said first surface and at said second surface, and wherein said second surface biases said cap into said initial position.

16. The method according to claim 14 wherein said step of contacting said cap with said printhead comprises contacting said cap along a leading edge of the cap such that the cap is de-coupled from said second surface and such that the cap is pivoted with respect to said first surface, and thereafter contacting a complete periphery of said cap such that the cap is de-coupled from said first surface and said second surface.

17. The method according to claim 14 further comprising contacting said cap support with said printhead to move said cap support from a rest position to a cap contacting position such that said cap seals around the ink-ejecting nozzles of the printhead.

18. The method according to claim 17 further comprising providing a cap frame including inclined slots, wherein said cap support is supported on said cap frame at said inclined slots, and wherein said step of moving said cap support from a rest position to a cap contacting position comprises contacting said cap support with said printhead to move said cap support along said inclined slots.

19. An inkjet printing mechanism, comprising:

a printhead having ink-ejecting nozzles and being movable between a printzone that defines a print feed direction and a printhead servicing region;

a sled positioned in said servicing region and including first and second surfaces, said second surface sloped with respect to said print feed direction; and a sealing member secured to said sled and being movable between a rest position and a sealing position around the printhead nozzles, the sealing member including a first leg pivotally contacting said first surface in the rest position and a second leg slidably contacting the second surface in the rest position, and wherein in the sealing position said printhead contacts said sealing member such that said first leg and said second leg are removed from contact with said sled.

20. A system for capping the ink-ejecting nozzles of a printhead in an inkjet printing apparatus, comprising:

means for capping the ink-ejecting nozzles of the printhead;

means for moving the capping means from a nominal position into a capping position against the ink-ejecting nozzles of the printhead;

means for biasing the capping means into said nominal position when said capping means is not positioned against the ink-ejecting nozzles of the printhead; and means for pivoting the capping means with respect to the printhead as the capping means is moved from the nominal position into the capping position.

21. The system according to claim 20 wherein said means for moving the capping means comprises a printhead carriage.

22. The system accordingly to claim 20 wherein said means for biasing comprises a biasing element and a cap sled having a biasing surface inclined with respect to a printmedia feed direction of the printing apparatus, wherein said biasing element biases the capping means along said biasing surface.

23. The system accordingly to claim 20 wherein said means for pivoting comprises a cap sled having a pivoting surface positioned parallel to a printmedia feed direction of the printing apparatus, wherein said pivoting surface facilitates pivoting of said capping means with respect to said pivoting surface as the capping means is moved into said capping position.

24. A capping system for sealing around ink-ejecting nozzles of a printhead in an inkjet printing mechanism, comprising:

a cap frame including ramped grooves therein;

a cap sled secured to said cap frame at said ramped grooves so as to move from a rest position to a capping position, said cap sled including a first set of recesses each including a contact surface positioned parallel to a printmedia feed direction of the printing mechanism, and a second set of recesses each including a biasing surface positioned at an acute angle with respect to the printmedia feed direction, and a stop surface positioned perpendicular to the printmedia feed direction;

a cap base including a first set of outwardly extending projections captured within said first set of recesses, a second set of outwardly extending projections captured within said second set of recesses, wherein said first set of projections each include a rounded surface adapted for pivotal movement against said contact surfaces;

a cap secured to said cap base and manufactured of an elastomeric material, said cap being adapted for sealing the nozzles of an inkjet printhead when said cap is in a sealing position; and a biasing element positioned between said cap sled and said cap base, said biasing element biasing said first set of projections against corresponding ones of said contact surfaces and biasing said second set of projections against corresponding ones of said biasing surfaces and said stop surfaces when said cap is in a nominal position.

25. A cap sled for supporting a cap adapted for sealing around the nozzles of an inkjet printhead, comprising:

a base that defines a plane;

a first region adapted for securing the cap thereto and including a biasing surface inclined with respect to said plane; and a second region adapted for securing the cap thereto and including a pivoting surface adapted to facilitate pivotal movement of a cap with respect to said cap sled as the cap is moved from a nominal position to a sealing position around the nozzles of an inkjet printhead.

26. A cap sled according to claim 25 wherein said pivoting surface is generally flat.

27. A cap sled according to claim 25 wherein said second region further includes a stop surface positioned perpendicular to said plane and defining a nominal position of the cap.

28. A capping system for sealing the pens of an inkjet printing mechanism, comprising:

a cap base including a plurality of outwardly extending legs, each leg defining a rounded upper contacting surface; and a cap secured to said cap base and manufactured of an elastomeric material, said cap being adapted for sealing the pens of an inkjet printing mechanism when said cap is in a sealing position.

29. A capping system according to claim 28 wherein said cap defines a width, and wherein a distance from said rounded upper contacting surface to an upper surface of said cap is less than said width.

* * * * *